US011118860B2

(12) United States Patent
Zimmer

(10) Patent No.: US 11,118,860 B2
(45) Date of Patent: Sep. 14, 2021

(54) SHOULDER STOCK ASSEMBLY FOR A PISTOL

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 16/390,114

(22) Filed: Apr. 22, 2019

(65) Prior Publication Data

US 2019/0323795 A1 Oct. 24, 2019

Related U.S. Application Data

(60) Provisional application No. 62/661,491, filed on Apr. 23, 2018.

(51) Int. Cl.

| | |
|---|---|
| ***F41C 23/12*** | (2006.01) |
| ***F41C 23/04*** | (2006.01) |
| ***F41A 35/02*** | (2006.01) |
| ***F41A 3/72*** | (2006.01) |

(Continued)

(52) U.S. Cl.

CPC ..... *F41C 23/12* (2013.01); *F41A 3/72* (2013.01); *F41A 35/02* (2013.01); *F41C 23/04* (2013.01); *F41C 23/14* (2013.01); *F41G 11/003* (2013.01)

(58) Field of Classification Search

CPC ..... F41C 23/04; F41C 23/12; F41C 23/14; F41A 3/72

See application file for complete search history.

(56) References Cited

U.S. PATENT DOCUMENTS

| | | | |
|---|---|---|---|
| 3,685,194 | A | 8/1972 | Coon |
| 4,271,623 | A | 6/1981 | Beretta |
| 8,677,669 | B1 | 3/2014 | Vesligaj |

(Continued)

FOREIGN PATENT DOCUMENTS

CA 2824803 A1 * 7/2012 ..... F41A 19/43

OTHER PUBLICATIONS

Doug E, Flux Brace Introduced for Glock 17 Pistols by Flux Defense [online], The Firearm Blog, [dated Feb. 1, 2019], [retrieved on Apr. 20, 2019], Retrieved from the internet <URL: https://www.thefirearmblog.com/blog/2019/02/01/flux-brace/>. pp. 1-5.

(Continued)

*Primary Examiner* — Stephen Johnson

(74) *Attorney, Agent, or Firm* — F. Wayne Thompson, Jr.; Asgaard Patent Services, LLC

(57) ABSTRACT

Implementations of a shoulder stock assembly for a pistol are provided. The shoulder stock assembly is configured for use in attaching a shoulder stock to a handgun, thereby providing additional stability to a user aiming and firing the handgun. In some implementations, the shoulder stock assembly is also configured to position an optical sight (e.g., a reflex type sight) so that is can be used to aim the handgun. In some implementations, the shoulder stock assembly comprises a chassis configured to be secured to a frame of a handgun and used to position an optical sight over a slide of the handgun, a shoulder stock secured to the chassis by a hinge assembly, a removable backstrap assembly configured to further secure the chassis to the handgun frame, and a charging handle that can be used to manually operate the slide of the handgun or another suitable combination thereof.

19 Claims, 15 Drawing Sheets

(51) Int. Cl.
*F41G 11/00* (2006.01)
*F41C 23/14* (2006.01)

(56) References Cited

U.S. PATENT DOCUMENTS

| | | | | |
|---|---|---|---|---|
| 8,887,432 | B2 * | 11/2014 | Oz | F41C 23/12 42/71.02 |
| 9,927,207 | B1 | 3/2018 | Haugland | |
| 10,054,393 | B2 * | 8/2018 | Kedairy | F41C 23/12 |
| 2011/0088305 | A1 * | 4/2011 | Oz | F41A 35/06 42/69.01 |
| 2011/0107644 | A1 * | 5/2011 | Faifer | F41G 11/003 42/75.02 |
| 2011/0219656 | A1 * | 9/2011 | McGarry | F41A 15/16 42/70.06 |
| 2018/0003462 | A1 * | 1/2018 | Chavez | F41G 1/35 |
| 2018/0023912 | A1 * | 1/2018 | Cudazzo | F41A 17/72 89/136 |
| 2018/0202732 | A1 * | 7/2018 | Gibbens | F41A 3/66 |
| 2018/0224233 | A1 † | 8/2018 | Omar | |
| 2018/0224234 | A1 † | 8/2018 | Omar | |
| 2019/0170480 | A1 * | 6/2019 | Toole | F41G 11/004 |
| 2019/0226798 | A1 * | 7/2019 | Faifer | F41C 23/12 |

OTHER PUBLICATIONS

Eric B, B&T USW-G17 Conversion kit for the Glock 17 & 19 [online], The Firearm Blog, [dated Feb. 25, 2019], [retrieved on Apr. 20, 2019], Retrieved from the internet <URL: https://www.thefirearmblog.com/blog/2019/02/25/bt-glock-conversion-kit/>. pp. 1-6.

* cited by examiner
† cited by third party

SHOULDER STOCK ASSEMBLY FOR A PISTOL

CROSS REFERENCE TO RELATED APPLICATION

This application claims the benefit of U.S. Provisional Application Ser. No. 62/661,491, which was filed on Apr. 23, 2018, the entirety of which is incorporated herein by reference.

TECHNICAL FIELD

This disclosure relates to implementations of a shoulder stock assembly for a pistol.

BACKGROUND

A pistol (or handgun) is a short-barreled firearm than can be held and used with one hand. Compared to a rifle with a shoulder stock, pistols are relatively hard to shoot accurately. Shoulder stocks are configured to be braced against the shoulder for stability while the rifle is being fired. This is one feature of the rifle that allows the shooter to mitigate recoil, and increase speed and accuracy while firing. Therefore, it would be advantageous if a shoulder stock could be attached to a pistol.

Also, the majority of pistols come from the factory with iron sights. Typical iron sights provided on a pistol include a front post and a rear notch which must be aligned to aim the pistol. Mounting an optical sight on a pistol offers a shooter several advantages over using iron sights alone. Optical sights provide a simplified sight picture comprised of a single illuminated aiming point in place of the front post and rear notch of iron sights. In this way, a shooter's accuracy and/or speed with a pistol may improve. Further, a shooter may be able to aim with the illuminated aiming point of an optical sight in environmental conditions that would make visual alignment of the iron sights difficult or impossible, low light conditions for example.

However, given the design of most pistols, attaching an optical sight may be difficult to do. In order to accommodate an optical sight, the slide of the pistol may need to be permanently modified in order to mount an optical sight thereon, milled for example. If the user decides to switch to a new optical sight, further modifications to the pistol may be required. In some instances, the pistol may not be suitable for further modification.

Accordingly, it can be seen that needs exist for the shoulder stock assembly disclosed herein. It is to the provision of a shoulder stock assembly that is configured to address these needs, and others, that the present invention is primarily directed.

SUMMARY OF THE INVENTION

Implementations of a shoulder stock assembly for a pistol are provided. The shoulder stock assembly is configured for use in attaching a shoulder stock to a handgun, thereby providing additional stability to a user aiming and firing the handgun. In some implementations, the shoulder stock assembly is also configured to position an optical sight (e.g., an Aimpoint® Micro sight or other reflex type sight) so that it can be used to aim the handgun.

In some implementations, the shoulder stock assembly comprises: a chassis configured to be secured to the frame of a handgun; a shoulder stock secured to the chassis by a hinge assembly; and a backstrap assembly configured to be mounted to the grip portion of the handgun frame and attached directly to the chassis. The chassis includes a mounting platform configured to position an optical sight mounted thereon over the slide.

In another implementation, the shoulder stock assembly comprises: a chassis configured to be removably secured to the grip portion of a handgun frame; a fastening pin configured to secure the chassis to the grip portion of the handgun frame; and a shoulder stock secured to the chassis. The fastening pin extends through a portion of the chassis and the grip portion of the handgun frame.

In yet another implementation, the shoulder stock assembly comprises: a chassis configured for use with a handgun; a fastener configured to secure the chassis to the frame of the handgun; and a shoulder stock secured to the chassis. The fastener extends through an opening in the chassis and a trigger pin hole in the handgun frame. A portion of the chassis is configured to be secured directly to the dustcover of the handgun frame.

In still yet another implementation, the shoulder stock assembly comprises: a chassis configured to be removably secured to the dustcover of a handgun frame; and a shoulder stock secured to the chassis. The chassis includes a clamp arm comprising a fixed bracket that is used in conjunction with an electronic device (e.g., a weapon mounted light) to secure the fixed bracket, and thereby the chassis, to the dustcover of the handgun frame.

BRIEF DESCRIPTION OF THE DRAWINGS

Like reference numerals refer to corresponding parts throughout the several views of the drawings.

DETAILED DESCRIPTION

Figure 1:
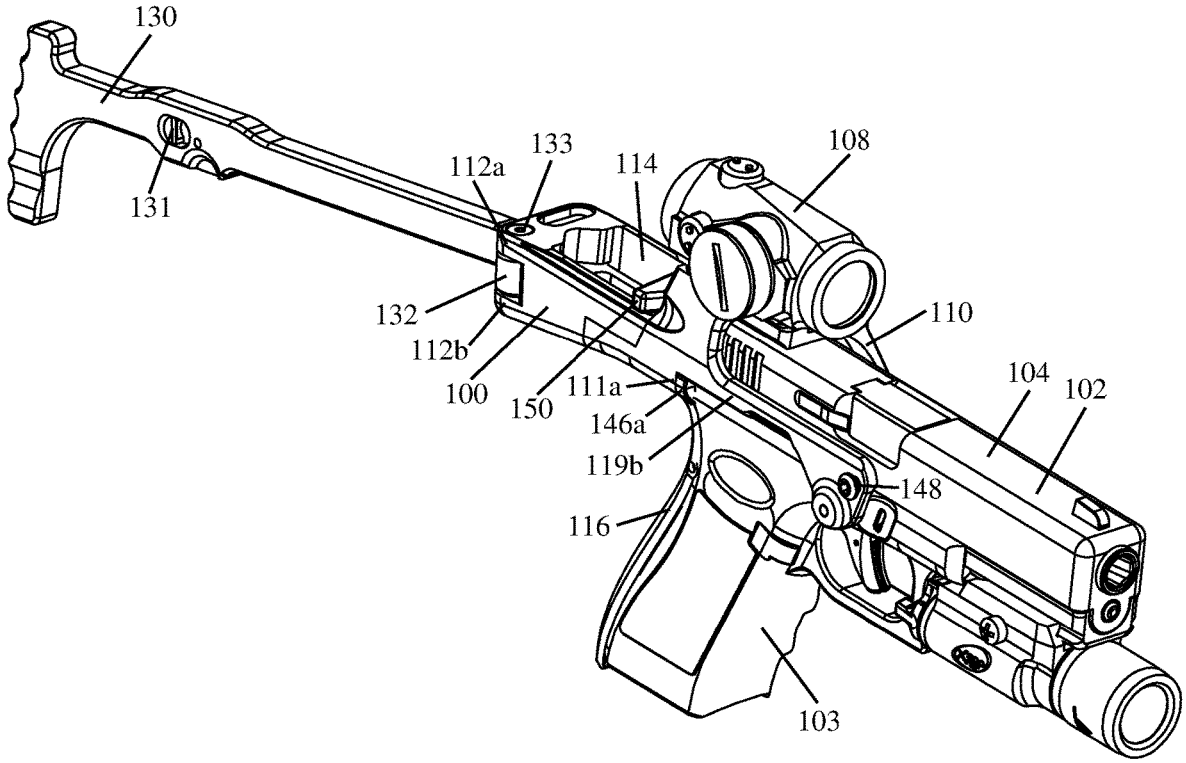
FIGS. 1-7 illustrate an example shoulder stock assembly manufactured in accordance with the principles of the present disclosure, wherein the shoulder stock assembly is attached to a handgun.

FIGS. 1-8 illustrate an example implementation of a shoulder stock assembly for a pistol 100 according to the principles of the present disclosure. In some implementations, the shoulder stock assembly 100 may be configured for use in attaching a shoulder stock 130 to a handgun 102, thereby providing additional stability to a user aiming and firing the handgun 102. In some implementations, the shoulder stock assembly 100 may also be configured to position an optical sight 108 (e.g., an Aimpoint® Micro sight or other reflex type sight) for use aiming the handgun 102.

As shown in FIGS. 1-8, in some implementations, the shoulder stock assembly 100 comprises a chassis 110 configured to secure to a frame 103 of the handgun 102 and position an optical sight 108 over a slide 104 thereof, a shoulder stock 130 secured to the chassis 110 by a hinge assembly 132, a removable backs trap assembly 116 configured to further secure the chassis 110 to the handgun frame 103, and a charging handle 150 that can be used to manually operate the slide 104 of the handgun 102; or another suitable combination thereof.

Figure 3:
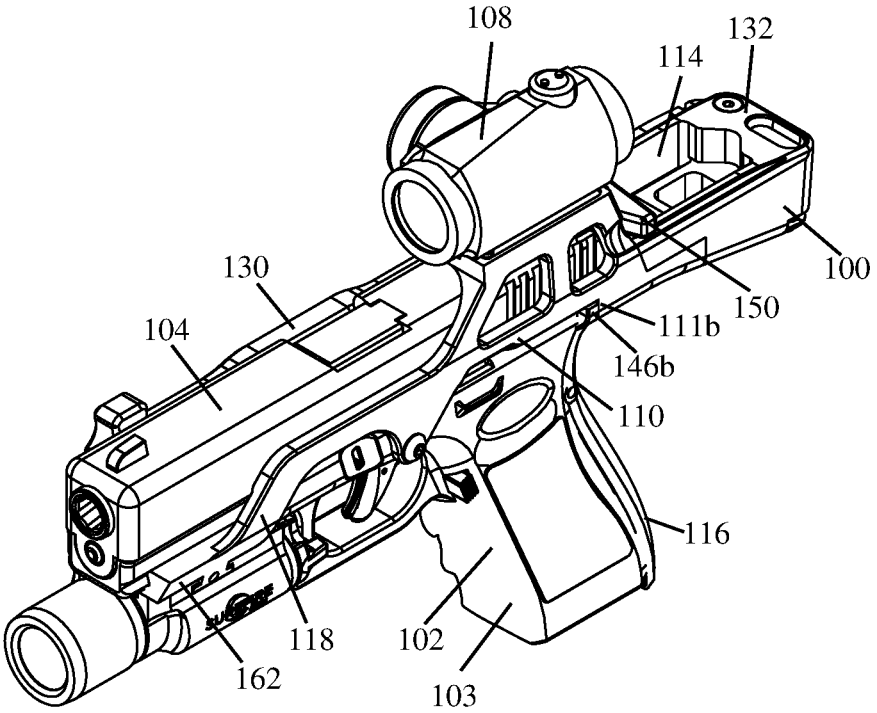
Figure 6:
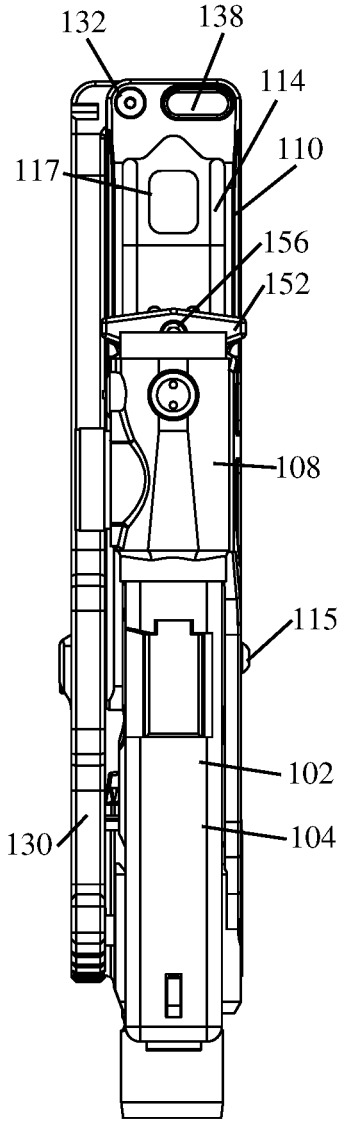
Figure 8:
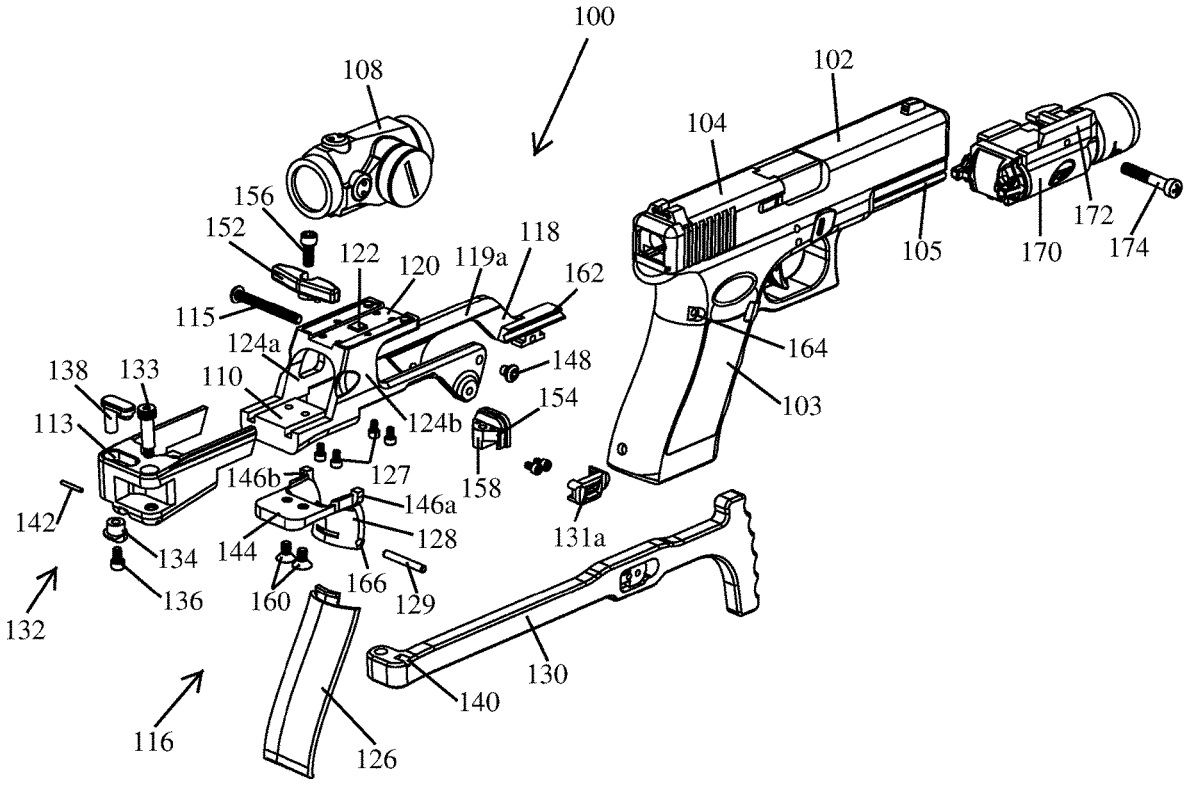
FIG. 8 illustrates an exploded view of the shoulder stock assembly shown in FIGS. 1-7.
Figure 9:
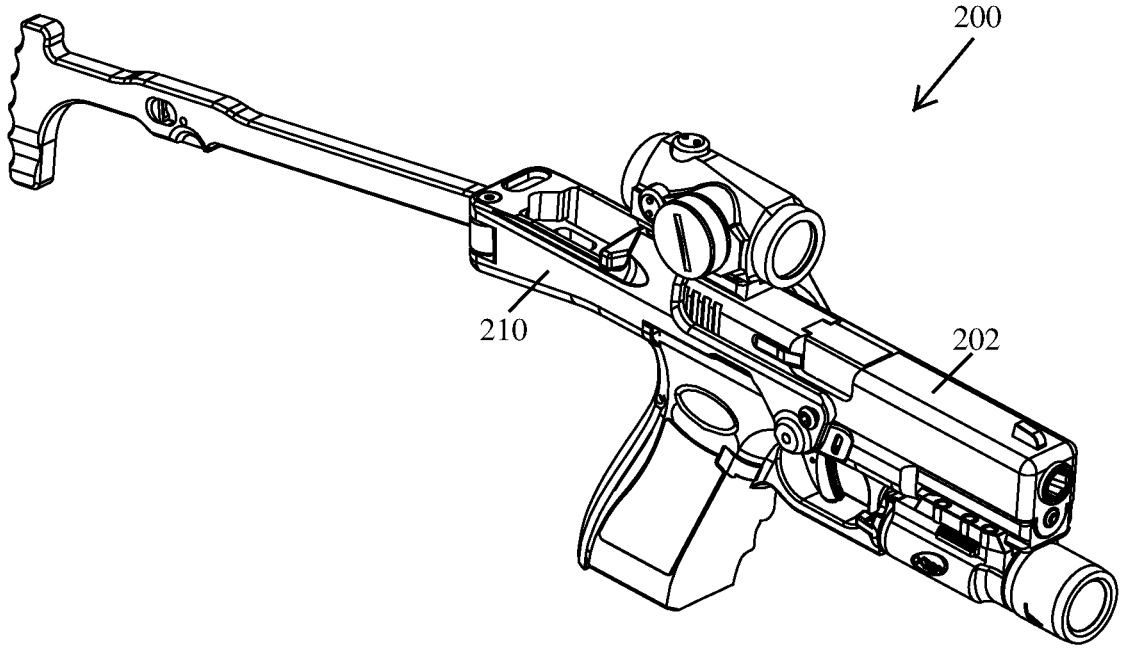
FIGS. 9-14 illustrate another example shoulder stock assembly manufactured in accordance with the principles of the present disclosure, wherein the shoulder stock assembly is attached to a handgun.
Figure 10:
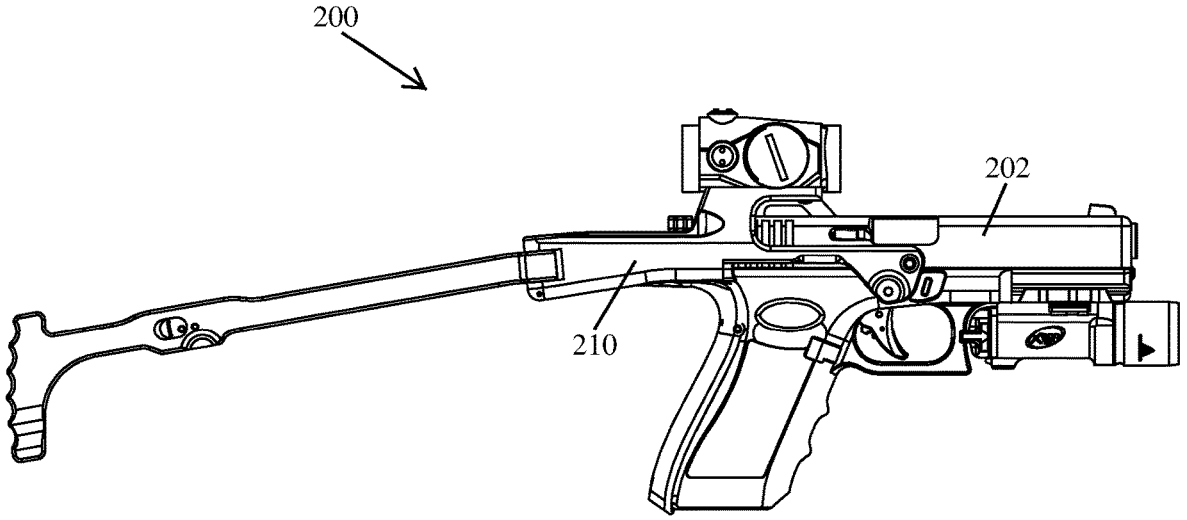
Figure 11:
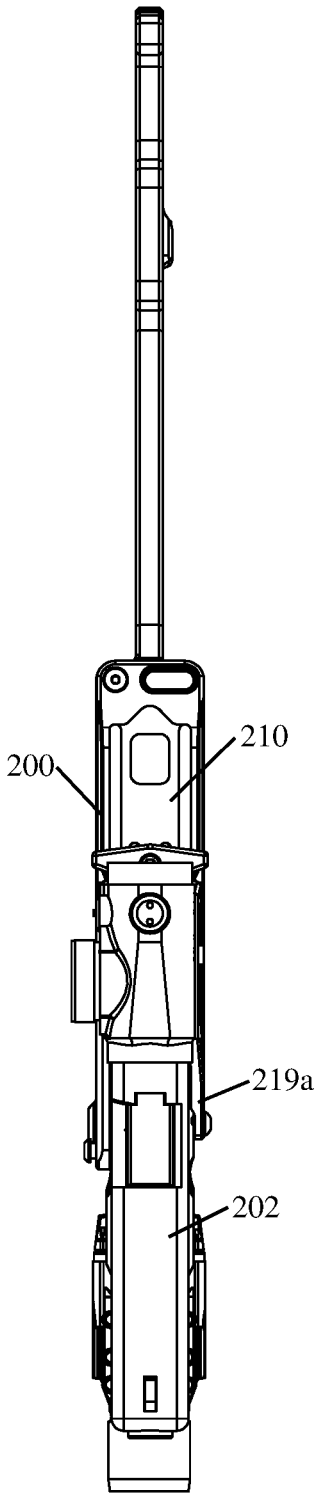
Figure 12:
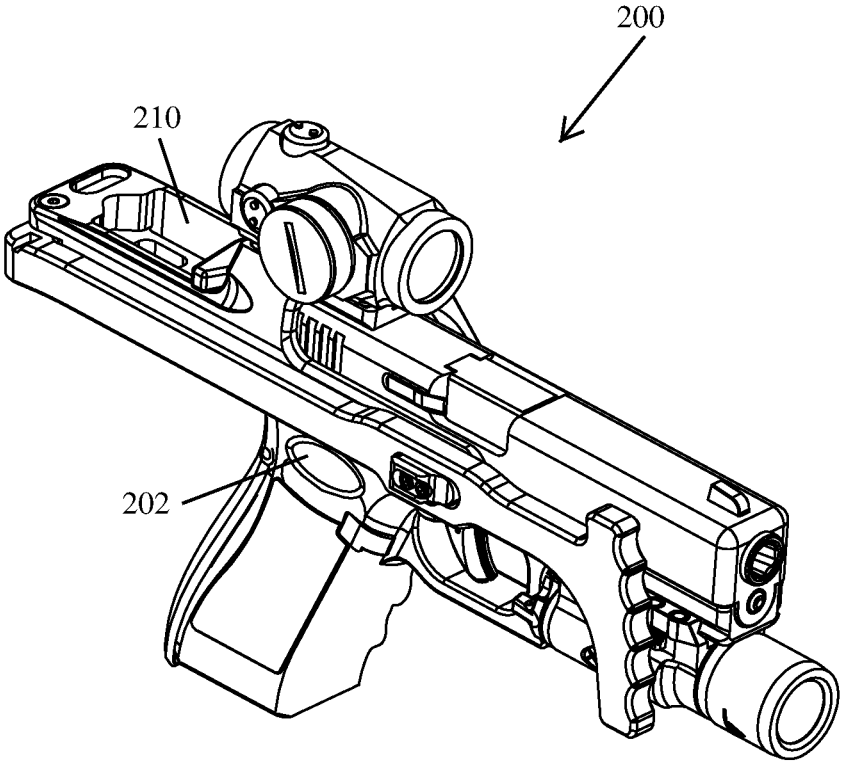
Figure 13:
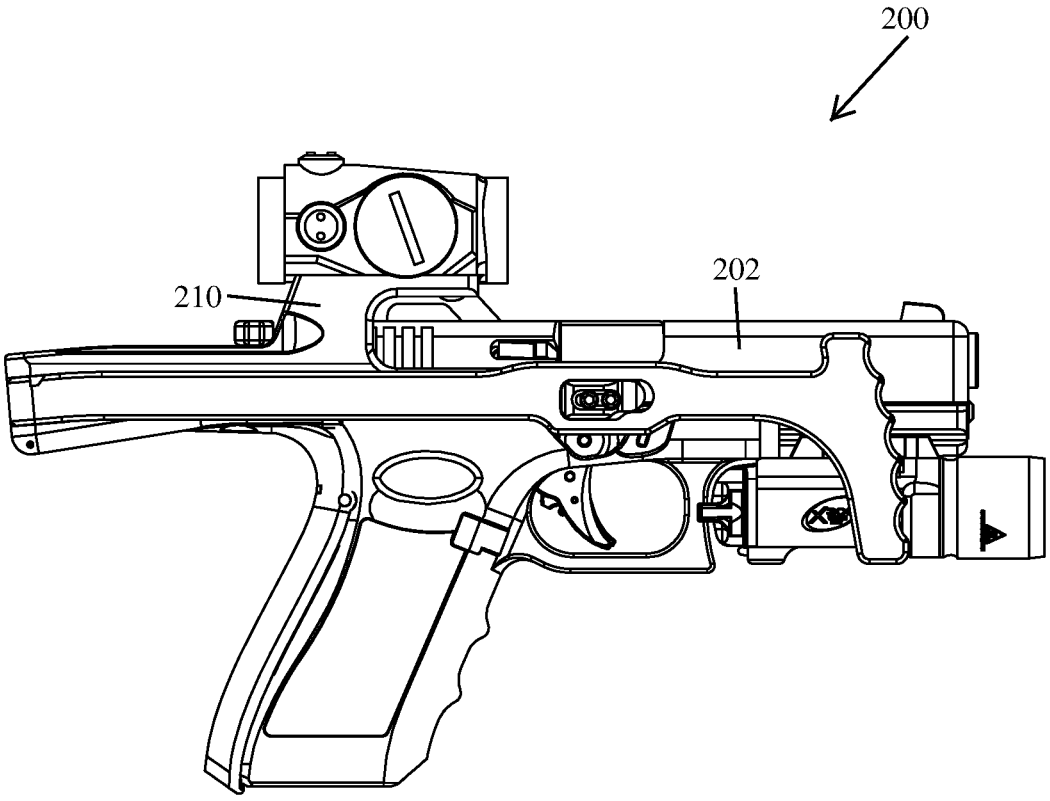

As shown in FIGS. 3, 6, and 8, in some implementations, the chassis 110 may comprise a reciprocation channel 114 for the handgun slide 104, a mounting platform 120, the hinge assembly 132, a clamp arm 118 that can be used to secure the chassis 110 to the dustcover 105 (e.g., an accessory rail thereon) of a handgun 102; or a suitable combination thereof.

As shown in FIGS. 1-3 and 6, in some implementations, the reciprocation channel 114 may be a longitudinally extending cutout in the chassis 110. In some implementations, reciprocation channel 114 may be configured (i.e., dimensioned) so that the handgun slide 104 is able to reciprocate therein when the handgun 102 is fired or otherwise manipulated. In some implementations, the reciprocation channel 114 may include a debris opening 117 that extends through a bottom side thereof (see, e.g., FIG. 6). In this way, debris (e.g., fowling from the discharge of ammunition, water, environmental debris, etc.) may be prevented from accumulating and retarding the reciprocation of the handgun slide 104 when the handgun 102 is fired or the slide 104 is being manually manipulated.

Figure 4:
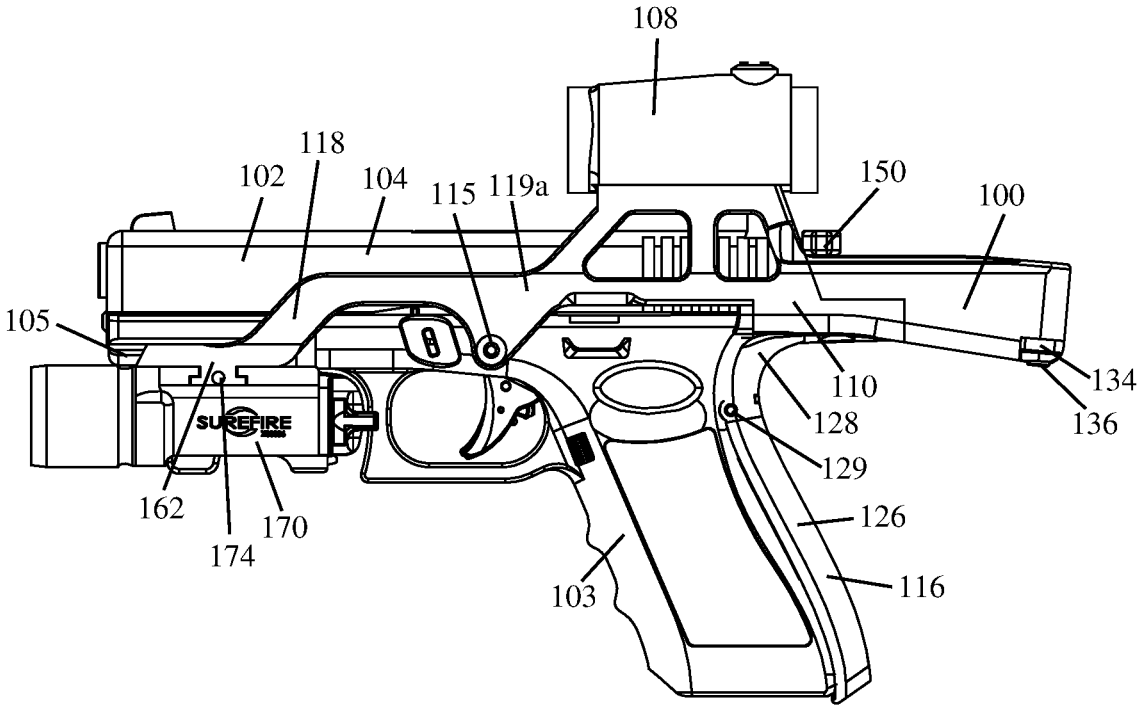

As shown in FIGS. 4, 6, and 8, in some implementations, the chassis 110 is configured to be secured to the frame 103 of the handgun 102 by a fastener 115 extending through a trigger pin hole in the frame 103. In some implementations, the fastener 115 may extend through an opening in a first side 119*a* of the chassis 110, through the trigger pin hole in the handgun frame 103, and into an opening in a second side 119*b* of the chassis 110 (see, e.g., FIGS. 4 and 5).

Figure 14:
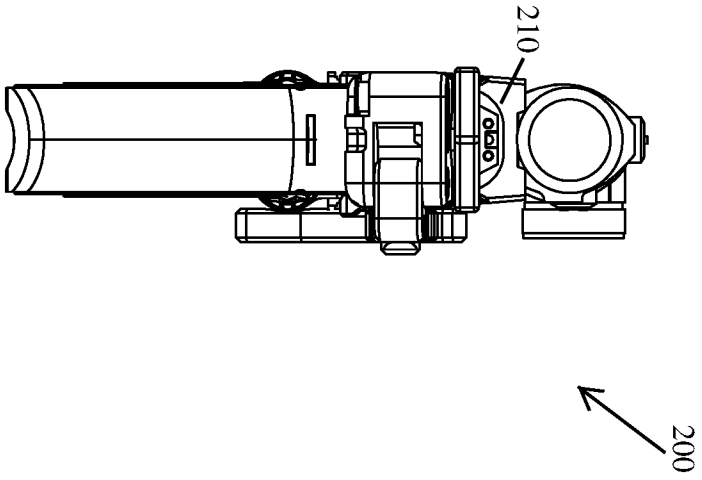
Figure 15:
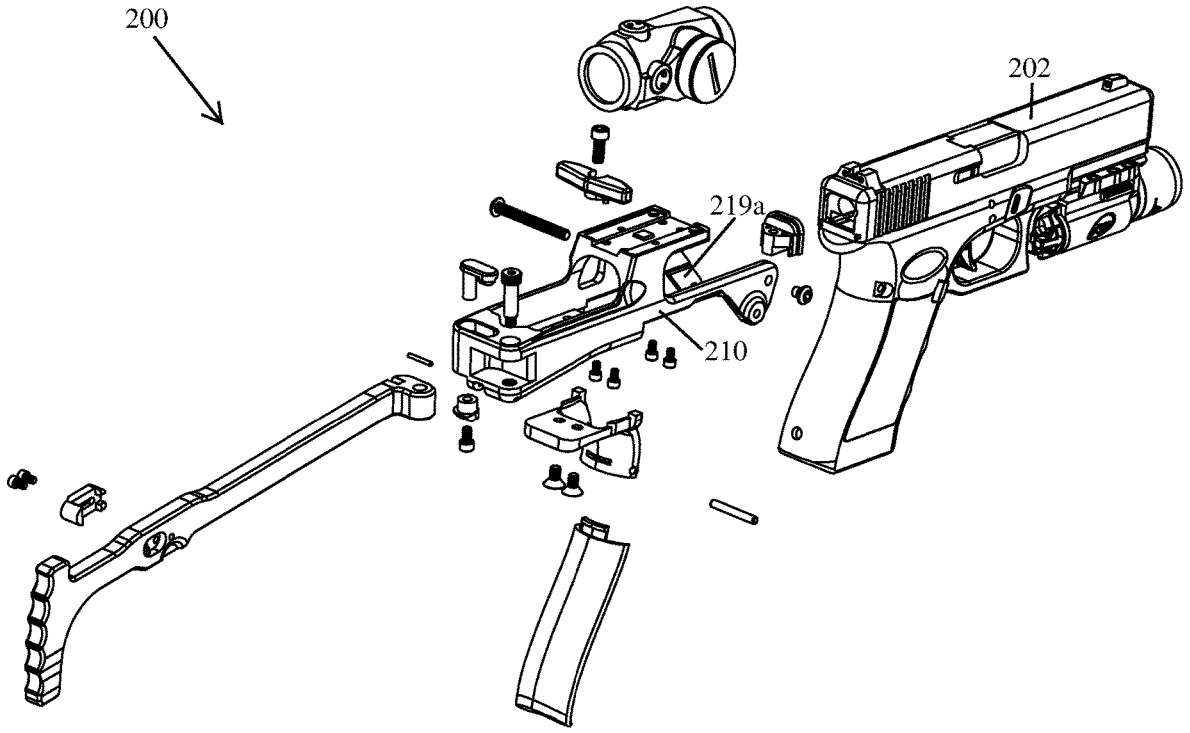
FIG. 15 illustrates an exploded view of the shoulder stock assembly shown in FIGS. 9-14.

As shown in FIG. 8, in some implementations, the mounting platform 120 may be supported by a first sidewall 124*a* and a second sidewall 124*b*, (collectively sidewalls 124), that extend from the first side 119*a* and the second side 119*b*, respectively, of the chassis 110. In some implementations, the mounting platform 120 and the sidewalls 124 define an opening therebetween that is configured (i.e., dimensioned) so that the handgun slide 104 is able to pass therethrough (see, e.g., FIGS. 4 and 5). In this way, the slide 104 is able to reciprocate when the handgun 102 is fired or otherwise manipulated. In some implementations, the mounting platform 120 may be configured so that sights mounted on the slide 104 can be used to aim the handgun 102 (see, e.g., FIG. 14). In some implementations, the mounting platform 120 may be configured to position an optical sight mounted thereon as close to the handgun slide 104 as is possible without interfering with the operation thereof (not shown).

As shown in FIG. 8, in some implementations, the mounting platform 120 and the sidewalls 124 may be a single unitary piece.

In some implementations, the mounting platform 120 may be removably secured between the first sidewall 124*a* and the second sidewall 124*b* of the chassis 110 by threaded fasteners (not shown). Thus, a user may change the type of optical sight positioned for use aiming the handgun 102 by selecting the appropriate mounting platform 120 and securing it between the sidewalls 124 of the chassis 110.

As shown in FIG. 8, in some implementations, the mounting platform 120 of the shoulder stock assembly 100 may comprise a relief (or channel) configured to receive at least a portion of an optical sight 108 therein. In some implementations, the mounting platform 120 may not include a relief (not shown). In some implementations, the mounting platform 120 may be configured (e.g., contoured, shaped, etc.) to interface with the mount compatible surface (e.g., the bottom side) of any suitable optical sight. In some implementations, the mounting platform 120 may include one or more openings that extend therethrough. In this way, fasteners 127 (e.g., screws) may be used to secure an optical sight 108 onto the top side of the mounting platform 120.

As shown in FIG. 8, in some implementations, the mounting platform 120 may include at least one recoil lug 122 thereon. In some implementations, each recoil lug 122 may be a projection extending from the top side of the mounting platform 120 that is configured to interface with a corresponding receptacle in the underside of the optical sight 108. In this way, an attached optical sight may be prevented from sliding back-and-forth due to the incidental vibrations associated with the discharge of a firearm. In some implementations, the mounting platform 120 may not have a recoil lug 121 thereon.

Figure 7:
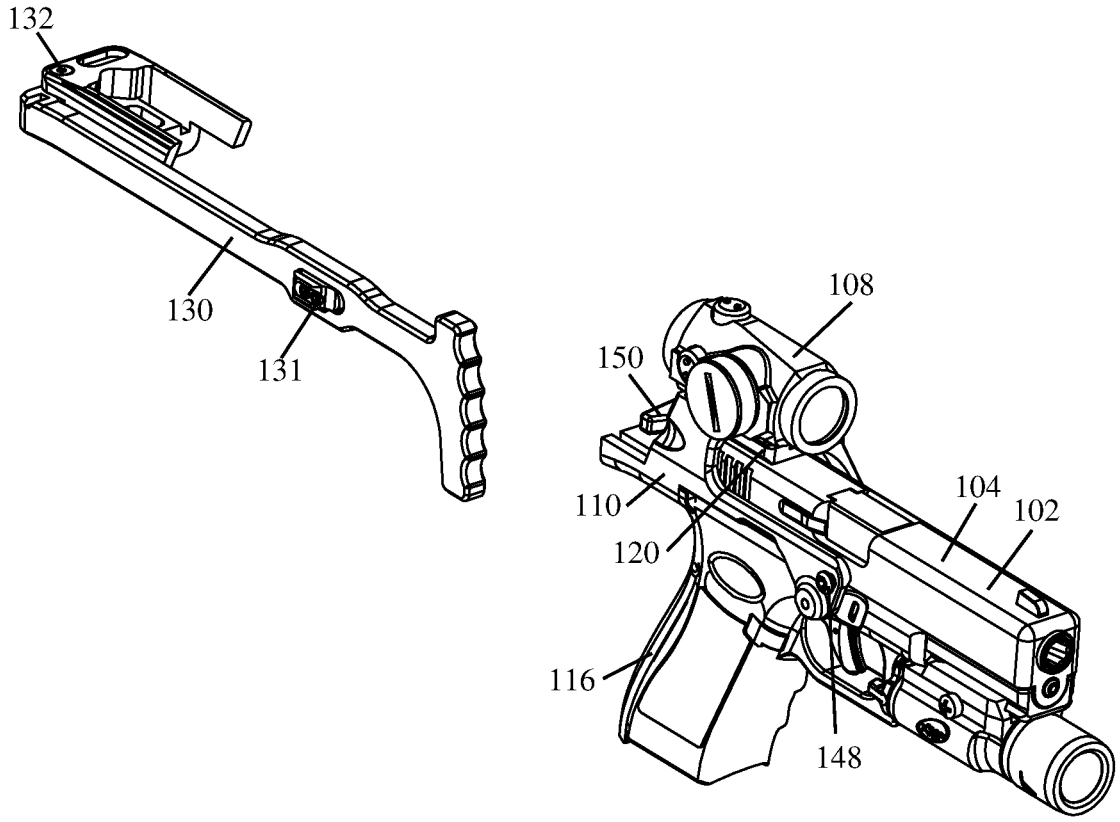

As shown in FIG. 7, in some implementations, the chassis 110 may comprise two portions that are removably secured to each other, a first end that includes the mounting platform 120 and a second end (or back end) that includes the hinge assembly 132. In some implementations, the second end of the chassis 110 may be removed from the first end thereof. In this way, the first end of the chassis 110 having the optical sight 108 thereon remains secured to the handgun frame 103 while the overall bulk of a handgun 102 is reduced by removing the hinge assembly 132 and shoulder stock 130. In some implementations, the chassis 110 may comprise a single unitary piece that includes both the mounting platform 120 and the hinge assembly 132 (not shown in FIGS. 1-8).

As shown in FIG. 4, in some implementations, the clamp arm 118 of the chassis 110 includes a fixed bracket 162 that can be used in conjunction with the mounting system of a weapon light 170 (e.g., a Surefire® model X300U-B® weapon light) to secure the chassis 110 to the dustcover 105 of the handgun frame 103, thereby further stabilizing the chassis 110 and the shoulder stock assembly 100 as a whole. Also, this configuration allows a weapon light 170 to be positioned on the handgun dustcover 105, as was intended, without offsetting it further from the bore axis of the handgun 102. In some implementations, the clamp arm 118 extends from one side (e.g., the first side 119*a*) of the chassis 110 and the fixed bracket 162 thereof is configured to interface with one side of a dustcover accessory rail (e.g., a Universal Rail or a MIL-STD 1913 accessory rail, well known to those of ordinary skill in the art). In some implementations, the weapon light 107 may be held in position on the dustcover 105 by a screw 174 extending through an opening in a clamp portion 172 of the weapon light 170, through a cross-slot in the dustcover 105 accessory rail, that is threadedly secured to the fixed bracket 162 of the clamp arm 118 (see, e.g., FIGS. 4 and 8). In this way, both the weapon light 170 and the chassis 110 may be secured to the handgun frame 103.

In some implementations, the shoulder stock assembly 100 may further comprise an adjustable bracket and a screw that are used in conjunction with the fixed bracket 162 on the clamp arm 118 of the chassis 110, instead of a weapon light 170, to secure (e.g., clamp) the chassis 110 to the dust cover 105 of the handgun frame 103 (not shown).

As shown in FIGS. 1-8, in some implementations, the shoulder stock 130 is a folding stock. In some implementations, the shoulder stock 130 includes a proximal portion that is secured to the chassis 110 and a distal portion configured for engaging with a shoulder of a user. In some implementations, the shoulder stock 130 may be moved between an unfolded position (see, e.g., FIG. 1) and a folded position (see e.g., FIG. 2), the handgun 102 may be fired with the shoulder stock 130 in either position. In some implementations, the shoulder stock 130 may be pivotally mounted to the back end of the chassis 110 by the hinge assembly 132.

In some implementations, the shoulder stock 130 may not be a folding stock (not shown). Instead, in some implementations, the shoulder stock 130 may be secured in a fixed (i.e., unfolded) position to the back end of the chassis 110.

In some implementations, the shoulder stock 130 may be configured to provide for an adjustable length of pull (i.e., be a telescoping shoulder stock) (not shown).

As shown in FIGS. 1-2, 5, and 7-8, in some implementations, the shoulder stock 130 may comprise a spring-loaded latch assembly 131. In some implementations, the spring-loaded latch assembly 131 may be configured to secure the shoulder stock 130 in the folded position by engaging with the head of a fastener 148 extending from the second side 119*b* of the chassis 110. In some implementations, the latch 131*a* of the latch assembly 131 may include a cam surface which cooperates with the head of the fastener 148. In this way, the spring-loaded latch assembly 131 may be configured to removably engage with the fastener 148 and thereby secure the shoulder stock 130 in the folded position. In some implementations, one or more threaded fasteners may be used to secure the spring-loaded latch assembly 131 to the shoulder stock 130.

Figure 2:
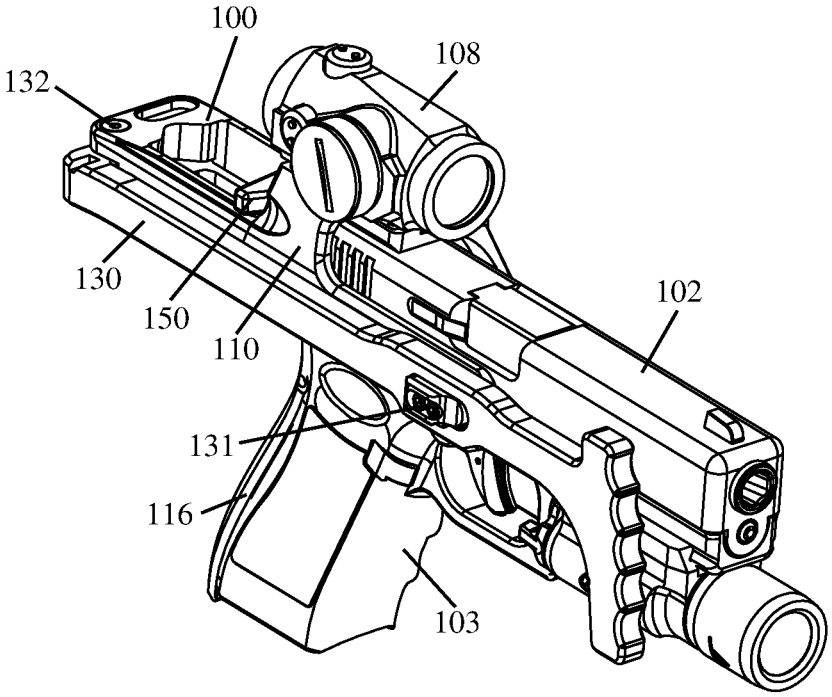

As shown in FIGS. 2 and 6, in some implementations, the hinge assembly 132 of the chassis 110 may be configured to permit the shoulder stock 130 to be folded substantially adjacent to the chassis 110 of the shoulder stock assembly 100. In this way, the overall length of the handgun 102 may be reduced for ease of transportation and/or concealment.

As shown in FIG. 8, in some implementations, the hinge assembly 132 may comprise a hinge pin 133 (e.g., a shoulder bolt) used to pivotally attached the shoulder stock 130 between two opposing spaced apart flanges 112*a*, 112*b* extending from the chassis 110 of the shoulder stock assembly 100, and a latch assembly configured to secure the shoulder stock 130 in the unfolded position.

In some implementations, the latch assembly may comprise a button 134 operably connected to a spring-biased latch 138 by a screw 136, the screw 136 being nested in the head of the button 134 (see, e.g., FIGS. 4 and 8). In some implementations, the latch 138 may be configured to engage with a latch receiving structure 140 located on the proximal portion of the shoulder stock 130. In this way, the latch assembly may be used to secure the shoulder stock 130 in the unfolded position (see, e.g., FIG. 1). In some implementations, the latch assembly may be configured so that pressing the button 134 thereof causes the latch 138 to disengage from the latch receiving structure 140 of the shoulder stock 130, thereby allowing the shoulder stock 130 to pivot on the hinge pin 133 and be folded (see, e.g., FIG. 2).

Figure 5:
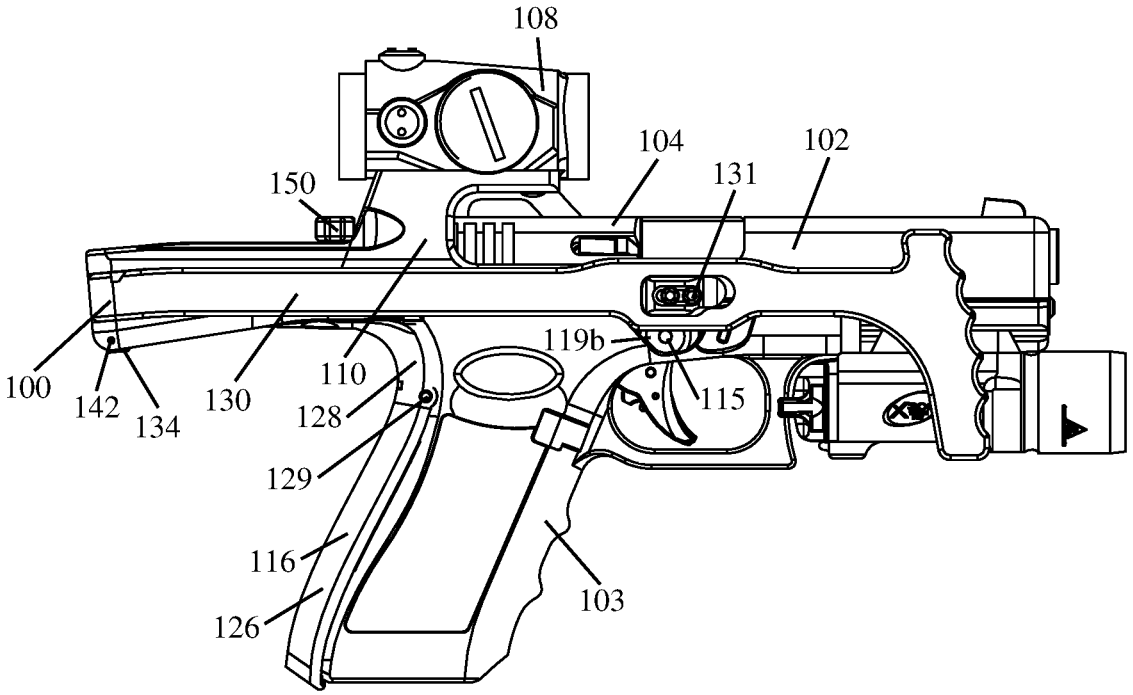

As shown in FIG. 5, in some implementations, the hinge assembly 132 may further comprise a roll pin 142 that extends through a bore in the flange 112*b* of the chassis 110, the bore is positioned so that the roll pin 142 will interface (i.e., make contact) with the hinge pin 133. In this way, the hinge pin 133 may be held in position while the shoulder stock 130 is moved between the folded and unfolded positions. In some implementations, a roll pin 142 may not be used to secure the hinge pin 133 in position.

As shown in FIGS. 1-5 and 7, in some implementations, the removable backs trap assembly 116 is configured to be selectively mountable to the grip portion of the handgun frame 103 and attached to the chassis 110 of the shoulder stock assembly 100. In this way, the removable backs trap assembly 116 may be used to further secure the chassis 110 to the handgun frame 103.

As shown in FIG. 8, in some implementations, the removable backs trap assembly 116 may comprise an elongate backstrap 126 and a beavertail 128. In some implementations, the elongate backs trap 126 and the beavertail 128 may be removably secured together. In some implementations, the elongate backs trap 126 and the beavertail 128 may be a single unitary piece (not shown). In some implementations, when the backs trap 126 and the beavertail 128 of the backs trap assembly 116 are mounted on the grip portion of the handgun frame 103, the through holes 164, 166 of the handgun frame 103 and the beavertail 128 are aligned such that a fastening pin 129 can be inserted (see, e.g., FIGS. 4 and 5). In some implementations, a flange portion 144 of the beavertail 128 may be attached to the bottom side of the chassis 110 by two fasteners 160, thereby securing the backstrap assembly 116 to the chassis 110. In this way, the backs trap assembly 116 may be used to further secure the chassis 110 to the handgun frame 100.

As shown in FIGS. 1, 3, and 8, in some implementations, the beavertail 128 of the backs trap assembly 116 may include a first upwardly extending arm 146*a* and a second upwardly extending arm 146*b* that are configured to interface with a first edge 146*a* and a second edge 146*b* of the chassis 100. In this way, the backstrap assembly 116 may be configured to assist with resisting longitudinal forces placed on the chassis 110 as a result of a user shouldering the handgun 102 equipped with the shoulder stock assembly 100.

In some implementations, the beavertail 128 may be used, without the elongate backstrap 126, to further secure the chassis 110 to the handgun frame 100.

In some implementations, the elongate backstrap 126 and/or beavertail 128 may include anchoring structures that are complementary to the anchoring structures found on the handgun frame 103. Thus, in some implementations, the elongate backstrap 126 and/or beavertail 128 may be secured to the frame of a Glock® handgun in the same, or in a similar, manner as prior art removable backs traps. In particular, in some implementations, the fastening pin 129 of the backs trap assembly 116 can also be used to secure the trigger mechanism housing, well known to one of ordinary skill in the art, within the handgun frame 103.

As shown in FIGS. 1-8, in some implementations, the charging handle 150 is attachable to the slide 104 of the handgun 102 and configured to function as a slide pull apparatus. In this way, for example, the handgun 102 may be loaded and/or unloaded. In some implementations, the charging handle 150 may be used as an independent part. In some implementations, the charging handle 150 may be configured to facilitate ambidextrous operation of the handgun slide 104.

As shown in FIG. 8, in some implementations, the charging handle 150 may comprise a handle portion 152 secured to a slide cover plate 154 by a fastener 156 (e.g., a threaded fastener such as a screw). In some implementations, the fastener 156 of the charging handle 159 extends through an opening in the handle portion 152 and into a threaded bore in the protuberance 158 of the slide cover plate 154. In some implementations, the handle portion 152 may form a T-shaped gripping portion when secured to the slide cover plate 154 (see, e.g., FIG. 6). In this way, the charging handle 150 facilitates ambidextrous operation of the handgun slide 104. In some implementations, the slide cover plate 154 of the charging handle 150 may be configured to attach to the handgun slide 104 in the same, or in a similar, manner as the factory slide cover plate of a Glock® handgun, well known to those of ordinary skill in the art.

FIGS. 1-8 illustrate an implementation of the shoulder stock assembly 100 in which the mounting platform 120 is configured for an Aimpoint® Micro optical sight 108 to be mounted thereon. However, it should be understood that, in some implementations, the mounting platform 120 may be configured so that a DOCTER® red dot sight, a Leupold® Deltapoint, a Trijicon RMR®, an Aimpoint® Acro P-1, or other optical sights having a similar foot print can be mounted onto the top side thereof.

In some implementations, the chassis 110 of the shoulder stock assembly 100 may be made of aluminum and/or another material that is suitably wear and impact resistant.

In some implementations, the shoulder stock 130 of the shoulder stock assembly 100 may be made of aluminum, an injection molded polymer, another material that is suitably wear and impact resistant, or a combination thereof.

While a shoulder stock 130 comprising a proximal portion that is secured to the chassis 110 and a distal portion configured for engaging with a shoulder of a user is shown and described herein, it should be understood that, in some implementations, the shoulder stock 130 could be replaced with a forearm stabilizing brace or other similar device.

FIGS. 9-15 illustrate another example implementation of a shoulder stock assembly 200 according to the principles of the present disclosure. In some implementations, the shoulder stock assembly 200 is similar to the shoulder stock assembly 100 discussed above but the chassis 210 is a single unitary piece and the first side 219*a* of the chassis 210 does not include a clamp arm. As shown in FIGS. 9-14, the shoulder stock assembly 200 may be attached to a handgun 202 without the use of a clamp arm.

As another nonlimiting example, in some implementations, a shoulder stock assembly 100, 200 may comprise a chassis 110, 210 having a shoulder stock 130 connected thereto by a hinge assembly 132, and a backs trap assembly 116; the mounting platform 120 for an optical sight being omitted therefrom.

As yet another nonlimiting example, in some implementations, the beavertail 128, or similar structure, may be a part (or portion) of the chassis 110 of the shoulder stock assembly 100. In this way, the fastening pin 129 can be used to secure the chassis 110 to the frame 103 of the handgun 102.

FIGS. 1-15 illustrate implementations of the shoulder stock assembly 100, 200 that have been configured for use with a Glock handgun 102, 202. However, it should be understood that, in some implementations, a shoulder stock assembly 100, 200 could be configured for use with one or more other handgun designs.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A shoulder stock assembly for use with a handgun comprising a slide and a frame, the frame of the handgun includes a grip portion and a dustcover, the shoulder stock assembly comprising:

a chassis configured to be secured to the frame of the handgun, the chassis includes a mounting platform configured to position an optical sight mounted thereon over the slide;

a shoulder stock secured to the chassis by a hinge assembly; and a backstrap assembly configured to be mounted to the grip portion of the frame and attached directly to the chassis.

2. The shoulder stock assembly of claim 1, further comprising a fastening pin configured to secure the backstrap assembly to the grip portion of the handgun, the fastening pin extends through a portion of the backstrap assembly and the grip portion of the frame.

3. The shoulder stock assembly of claim 1, wherein the chassis also includes a clamp arm comprising a fixed bracket that is used in conjunction with an electronic device to secure the fixed bracket, and thereby the chassis, to the dustcover of the handgun.

4. The shoulder stock assembly of claim 1, further comprising a charging handle that can be used to manually operate the slide of the handgun.

5. The shoulder stock assembly of claim 1, wherein the chassis also includes a reciprocation channel for the slide of the handgun.

6. A shoulder stock assembly for use with a handgun comprising a barrel, a slide that houses at least a portion of the barrel, and a frame, the frame of the handgun includes a grip portion and a dustcover, the shoulder stock assembly comprising:

a chassis configured to be removably secured to the grip portion of the frame of the handgun;

a fastening pin configured to secure the chassis to the grip portion of the frame, the fastening pin extends through a portion of the chassis and the grip portion of the frame; and a shoulder stock secured to the chassis.

7. The shoulder stock assembly of claim 6, further comprising a backstrap assembly configured to be mounted to the grip portion of the frame and attached directly to the chassis.

8. The shoulder stock assembly of claim 6, further comprising a charging handle that can be used to manually operate the slide of the handgun.

9. The shoulder stock assembly of claim 6, wherein the chassis includes a mounting platform configured to position an optical sight mounted thereon over the slide.

10. A shoulder stock assembly for use with a handgun comprising a barrel, a slide that houses at least a portion of the barrel, and a frame, the frame of the handgun includes a grip portion and a dustcover positioned underneath the barrel, the shoulder stock assembly comprising:

a chassis configured for use with the handgun;

a fastener configured to secure the chassis to the frame of the handgun, the fastener extends through an opening in the chassis and a trigger pin hole in the frame of the handgun; and a shoulder stock secured to the chassis;

wherein a portion of the chassis is configured to be secured directly to the dustcover of the frame of the handgun.

11. The shoulder stock assembly of claim 10, further comprising a fastening pin configured to secure the chassis to the grip portion of the handgun, the fastening pin extends through a portion of the shoulder stock assembly and the grip portion of the frame.

12. The shoulder stock assembly of claim 10, further comprising a backstrap assembly configured to be mounted to the grip portion of the frame and attached directly to the chassis.

13. The shoulder stock assembly of claim 10, further comprising a charging handle that can be used to manually operate the slide of the handgun.

14. The shoulder stock assembly of claim 10, wherein the chassis includes a mounting platform configured to position an optical sight mounted thereon over the slide.

15. A shoulder stock assembly for use with a handgun comprising a slide and a frame, the frame of the handgun includes a grip portion and a dustcover, the shoulder stock assembly comprising:

a chassis configured to be removably secured to the dustcover of the frame of the handgun, the chassis includes a clamp arm comprising a fixed bracket that is used in conjunction with an electronic device to secure the fixed bracket, and thereby the chassis, to the dustcover of the handgun; and a shoulder stock secured to the chassis.

16. The shoulder stock assembly of claim 15, further comprising a fastening pin configured to secure the chassis to the grip portion of the handgun, the fastening pin extends through a portion of the chassis and the grip portion of the frame.

17. The shoulder stock assembly of claim 15, further comprising a backstrap assembly configured to be mounted to the grip portion of the frame and attached directly to the chassis.

18. The shoulder stock assembly of claim 15, further comprising a charging handle that can be used to manually operate the slide of the handgun.

19. The shoulder stock assembly of claim 15, wherein the chassis includes a mounting platform configured to position an optical sight mounted thereon over the slide.

* * * * *